United States Patent [19]

Day

[11] Patent Number: 4,819,392

[45] Date of Patent: Apr. 11, 1989

[54] METAL FRAME SYSTEM

[76] Inventor: Robert L. Day, 9990 Edmore, Sun Valley, Calif. 91352

[21] Appl. No.: 46,638

[22] Filed: May 7, 1987

[51] Int. Cl.[4] ..... E06B 1/04

[52] U.S. Cl. ..... 52/211; 52/126.3; 52/213; 254/104

[58] Field of Search ..... 52/210, 211, 213, 214, 52/217, 126.1, 126.3, 126.5, 475, 656; 254/104; 49/504, 505

[56] References Cited

U.S. PATENT DOCUMENTS

| | | | |
|---|---|---|---|
| 464,921 | 12/1891 | Carr . | |
| 1,045,984 | 12/1912 | King . | |
| 1,870,579 | 8/1932 | Levene . | |
| 1,938,161 | 12/1933 | Whitacre . | |
| 2,066,718 | 1/1937 | Dietz . | |
| 2,170,690 | 8/1939 | Mafera . | |
| 2,303,739 | 12/1942 | Hasenburger et al. . | |
| 2,351,250 | 6/1944 | Yerian . | |
| 3,030,730 | 4/1962 | Costar | 248/188.2 |
| 3,167,842 | 2/1965 | Pauli, Jr. . | |
| 3,171,632 | 3/1965 | Jines . | |
| 3,194,363 | 7/1965 | Steffan et al. | 49/504 |
| 3,289,373 | 12/1966 | Miller . | |
| 3,724,135 | 4/1973 | Heliotes | 49/504 |
| 4,113,219 | 9/1978 | Mieyal . | |
| 4,135,335 | 1/1979 | Jensen . | |
| 4,334,258 | 8/1982 | Langenhorst . | |

FOREIGN PATENT DOCUMENTS

| | | | |
|---|---|---|---|
| 1215090 | 4/1966 | Fed. Rep. of Germany | 254/104 |
| 2327241 | 12/1974 | Fed. Rep. of Germany | 52/126.5 |
| 2338199 | 2/1975 | Fed. Rep. of Germany | 52/217 |
| 2547731 | 4/1977 | Fed. Rep. of Germany | 52/217 |
| 1258595 | 3/1961 | France | 52/126.3 |

*Primary Examiner*—John E. Murtagh
*Assistant Examiner*—Andrew Joseph Rudy
*Attorney, Agent, or Firm*—Leonard Tachner

[57] ABSTRACT

A metal frame system for use as a door frame, window frame and the like utilizing vertical frame members adapted for attachment to wood or steel studs, employs unique wedge member sets comprising pairs of complementary shaped wedges. Each of wedge members has two wedges of generally congruent shape but having inverted interface surfaces, one such interface surface abutting the other in compressive contiguous relation whereby to fill the space between the vertical member and the underlying wood stud. Linear movement of one wedge relative to the other provides an expedient adjustment capability for fitting the frame system into the study assembly. Rotation of one wedge relative to the other provides a convenient way of compensating for irregular wood or steel stud surfaces that might otherwise prevent proper orientation of the forms relation to the studs.

2 Claims, 5 Drawing Sheets

FIG. 6
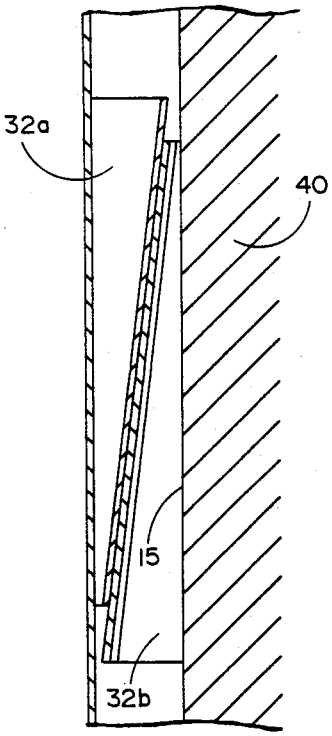
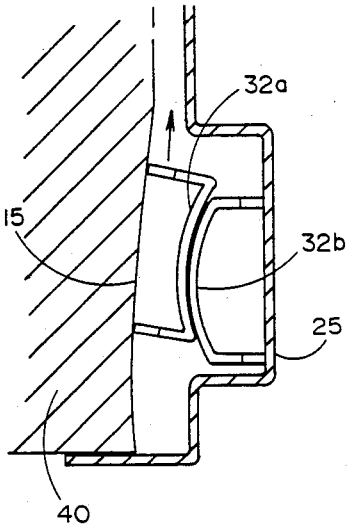
FIG. 7a
FIG. 7
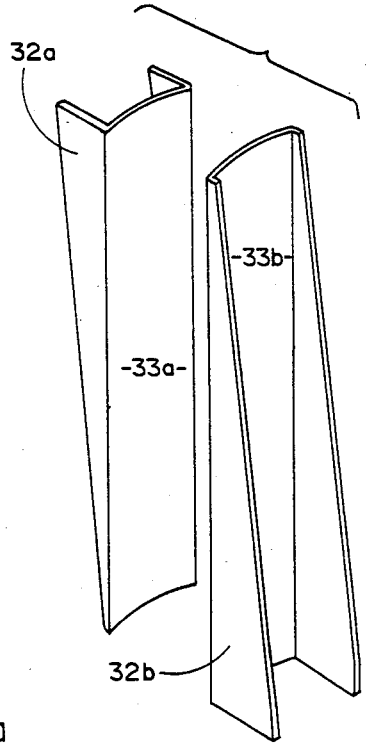
FIG. 8
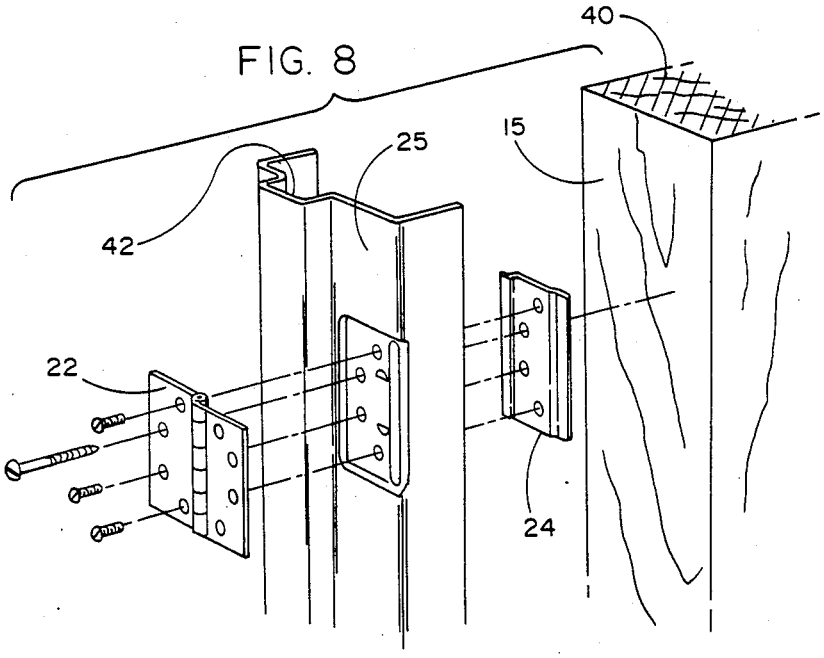

METAL FRAME SYSTEM

FIELD OF THE INVENTION

The present invention relates generally to metal frame assemblies such as door frames, window frames, and the like and more particularly, to a frame assembly characterized by the use of pairs of complementary wedges having curved interface surfaces which allow for linear and angular adjustment for attaching the frame and in the event the entry system is installed on warped or otherwise irregular surfaces.

PRIOR ART

Modern residential and commercial building techniques make it extremely desirable to permit the fabrication and installation of metal frame assemblies such as door frames, window frames and the like into a pre-existing wood frame or steel frame structure in an expedient manner. As a result, metal frame assemblies have become extremely popular because they can be economically and expediently installed onto standing wood frame or steel frame studs, the individual metal frame assembly pieces being prefabricated and brought to the site. One significant advantage of using prefabricated metal framing systems is the fact that the various component surfaces may be readily manufactured to relatively stringent tolerances to provide smooth precise surfaces having appropriate dimensions and angles for the installation. Unfortunately, the wood or steel members, such as vertical studs to which such framing assemblies are affixed, are often warped or rotated or otherwise inadvertently irregular thereby making it difficult if not impossible to properly orient the frame members relative to the underlying support structure. The present invention overcomes this problem by utilizing uniquely shaped wedge members which provide a convenient and expedient means for overcoming the difficulties in otherwise attempting to properly align and affix a metalized structure to an underlying warped surface such as that of a wood stud.

The use of wedge members in a structural application is not new per se and in fact, a thorough search of the prior art by the applicant has found a total of 14 patents each of which is relevant in varying degrees to the present invention. These U.S. Pat. Nos. are the following:

464,921, Carr
1,045,984, King
1,870,579, Levene
1,938,161, Whitacre
2,066,718, Dietz
2,170,690, Mafera
2,303,739, Hasenburger et al
2,351,250, Yerian
3,167,842, Pauli, Jr.
3,171,632, Jines
3,289,373, Miller
4,113,219, Mieyal
4,135,335, Jensen
4,344,258, Langenhorst U.S. Pat. No. 3,171,632 to Jines is directed to a leveling device and includes a top wedge and bottom wedge. The wedges are triangular in nature and include contact faces. The surfaces are not concave/convex, however, they do provide for runners formed on the contact face of the wedge which are insertable within the notches in the contact face. Thus, there is a guideway for one wedge with respect to the other wedge.

U.S. Pat. No. 3,289,373 to Miller is directed to a wedge-shaped anchor device and provides for the two wedges. The wedges are inclined in two directions as can be clearly seen in FIG. 1 to allow adjustment in two differing planes. However, once again, the wedges do not provide for concave/convex surface configurations to provide a guideway.

U.S. Pat. No. 2,351,250 to Yerian is directed to a battery service tool. A wedge element surface is provided with an arcuate section such as that provided and shown in FIG. 3. However, this is not used on opposing wedge members.

U.S. Pat. No. 464,921 to Carr is directed to a keel block and provides for a wedge-shaped base-block and another wedge-shaped block. The wedge-shaped block is insertable within the guideways of the wedge-shaped base-block and provides for a guideway between the wedges.

U.S. Pat. No. 3,167,842 to Pauli Jr. is directed to a spreader bar/tie rod arrangement for concrete wall forms. They provide a curvature in the transverse section of the spreader bar. Additionally, the tie rod is convex in contour and there is a wedging between the elements when used as shown in FIGS. 1 and 2.

U.S. Pat. No. 2,066,718 to Dietz is directed to an enclosure bulkhead. FIG. 7 shows the wedge-shaped elements which appear to be rather common in nature in this art.

None of the references found in the search show a curved wedge concept.

SUMMARY OF THE INVENTION

The present invention solves the aforementioned deficiency of the prior art by providing a metal frame assembly which utilizes a plurality of pairs of specially shaped wedges. The wedges are designed to be used in pairs in contiguous, compressed engagement along an interface surface, the interface of one wedge being arcuately curved in one direction such as convex and the interface surface of the other wedge being arcuately curved in an opposite complementary direction such as concave. Where the two surfaces are substantially contiguous they are congrument so that effectively one wedge can be rotated about the other while the wedges retain their contiguous engagement. Another feature of the present invention is the use of vertical frame members which provide suitable spaces for receiving the aforementioned wedge members. As a result, the wedge members and the vertical members may be readily integrated so that the wedge members are hidden from view between the vertical frame members and the underlying vertical wood studs upon which the frame assembly of the present invention may be installed. The wedge members provide a convenient and expedient means for providing firm pressured engagement between the vertical members of the frame and the underlying wood stud members even when the surfaces of the stud members are warped or rotated which would otherwise severely complicate and increase the cost of installing such frame assemblies. The wedge members are also readily adjusted linearly to permit easy variation in total frame width thereby accommodating commensurate variations in the distance between the wood or steel studs to which the frame assembly is attached.

OBJECTS OF THE INVENTION

It is therefore a principal object of the present invention to provide an improved framing assembly such as an entry door system of the type typically made of metal such as steel and adapted for being affixed to an underlying wood or steel structure, the present invention providing means for compensating for warped or irregularly configured wood surfaces which might otherwise interfere with the expeditious installation of such framing assemblies.

It is still an additional object of the present invention to provide a metal entry door system which utilizes a plurality of pairs of complementary wedge members, such wedge members being provided with arcuate interface surfaces of generally congruent shape thereby permitting relative motion of the wedges to compensate for warping or displacement of existing studs.

It is still an additional object of the present invention to provide an improved entry door system, the vertical members thereof providing suitable spaces for receiving at least one pair of complementary wedge members, the wedge members thus being hidden between the door frame vertical members and the underlying wood or steel frame structure, the wedge members being translatable and rotatable relative to one another for expediting the interface of the entry door assembly with the underlying structure.

BRIEF DESCRIPTION OF THE DRAWINGS

The aforementioned objects and advantages of the present invention, as well as additional objects and advantages thereof, will become more fully understood hereinafter as a result of a detailed description of a preferred embodiment when taken in conjunction with the following drawings in which:

FIG. 6 is a cross-sectional view of a vertical member and wedge members of the present invention taken along lines 6—6 of FIG. 3;

FIG. 7 is an isometric view of the wedge members of the present invention;

Figure 12:
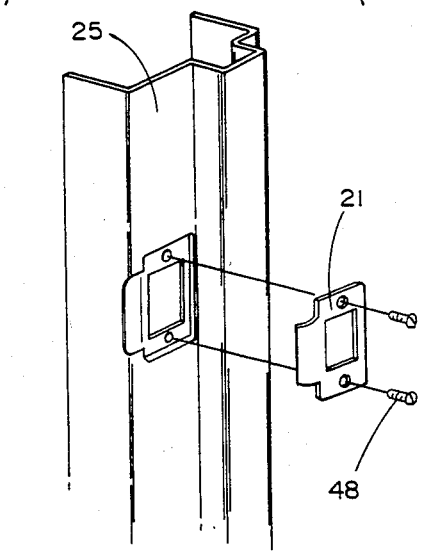
Figure 10:
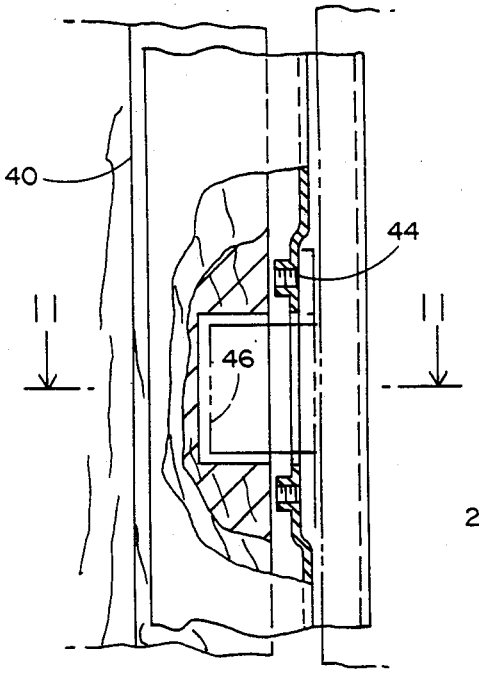
Figure 9:
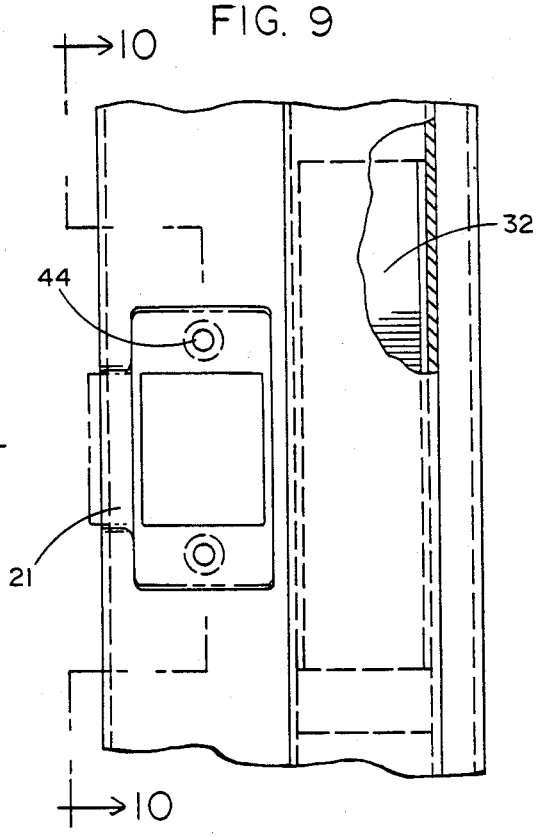
Figure 11:
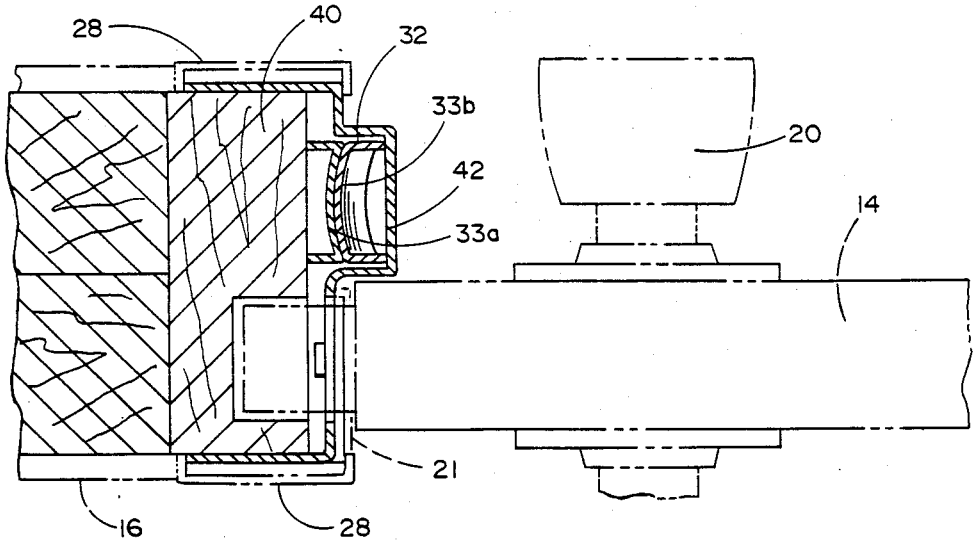

FIG. *7a* is an illustrative top view of the wedge members of the invention shown in a rotated configuration;

FIG. 8 is an exploded view of a portion of the present invention showing the relative position of a vertical member to an underlying wood stud;

FIG. 9 is an enlarged view of a portion of a second vertical member of the present invention;

FIG. 10 is a cross-sectional view of the vertical member of the invention shown in FIG. 9 and taken along lines 10—10 of that figure;

FIG. 11 is a cross-sectional view of the vertical member of FIG. 9 of the present invention taken along lines 11—11 of FIG. 10; and FIG. 12 is an isometric view of the vertical member of FIG. 9.

DETAILED DESCRIPTION OF A PREFERRED EMBODIMENT

Referring now to the drawings, it will be seen that an illustrative embodiment of the framing system 10 of the present invention comprises an entry door assembly 12 for supporting a conventional door 14 in a rectangular opening of a wall 16 adjacent a floor 18. The door is of a standard configuration having a knob 20 for securing the door by means of a striker plate 21, the door being hingedly attached to the frame by means of a plurality of hinges 22 secured to corresponding back-up plates 24. The entry door assembly 12 comprises first and second vertical frame members 25 with a horizontal frame member 26 or header forming a first end of a rectangle and threshold 30 forming the other end of a rectangle, the threshold being supported on the underlying floor 18. The entry door assembly 12 is preferably provided with a plurality of decorative molds 28 designed to attach to the exterior surfaces of the vertical frame member 25 and the horizontal frame member 26 by means of a plurality of clips 29.

Figure 1:
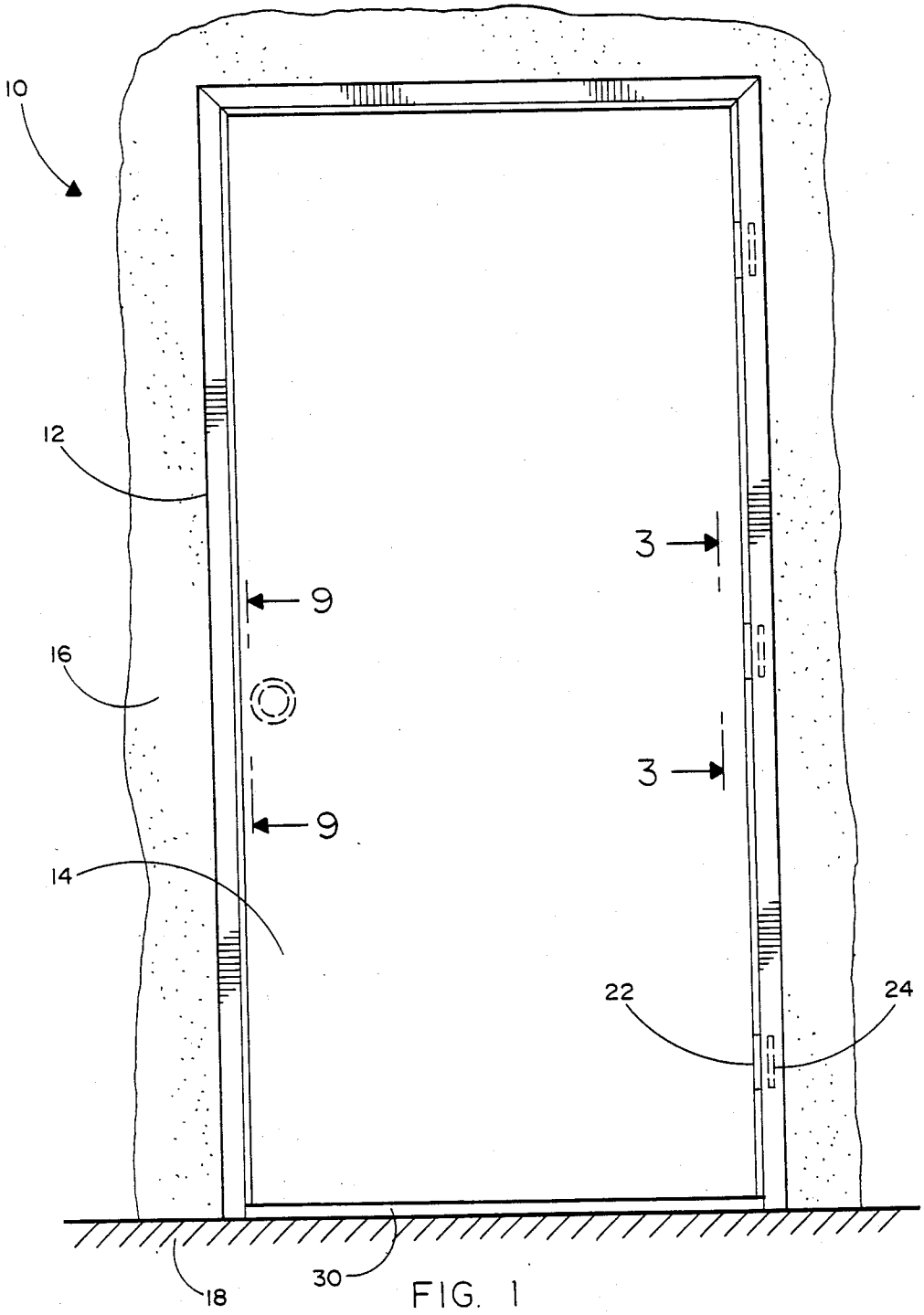
FIG. 1 is a plan view of a typical entry door configuration of the present invention.
Figure 2:
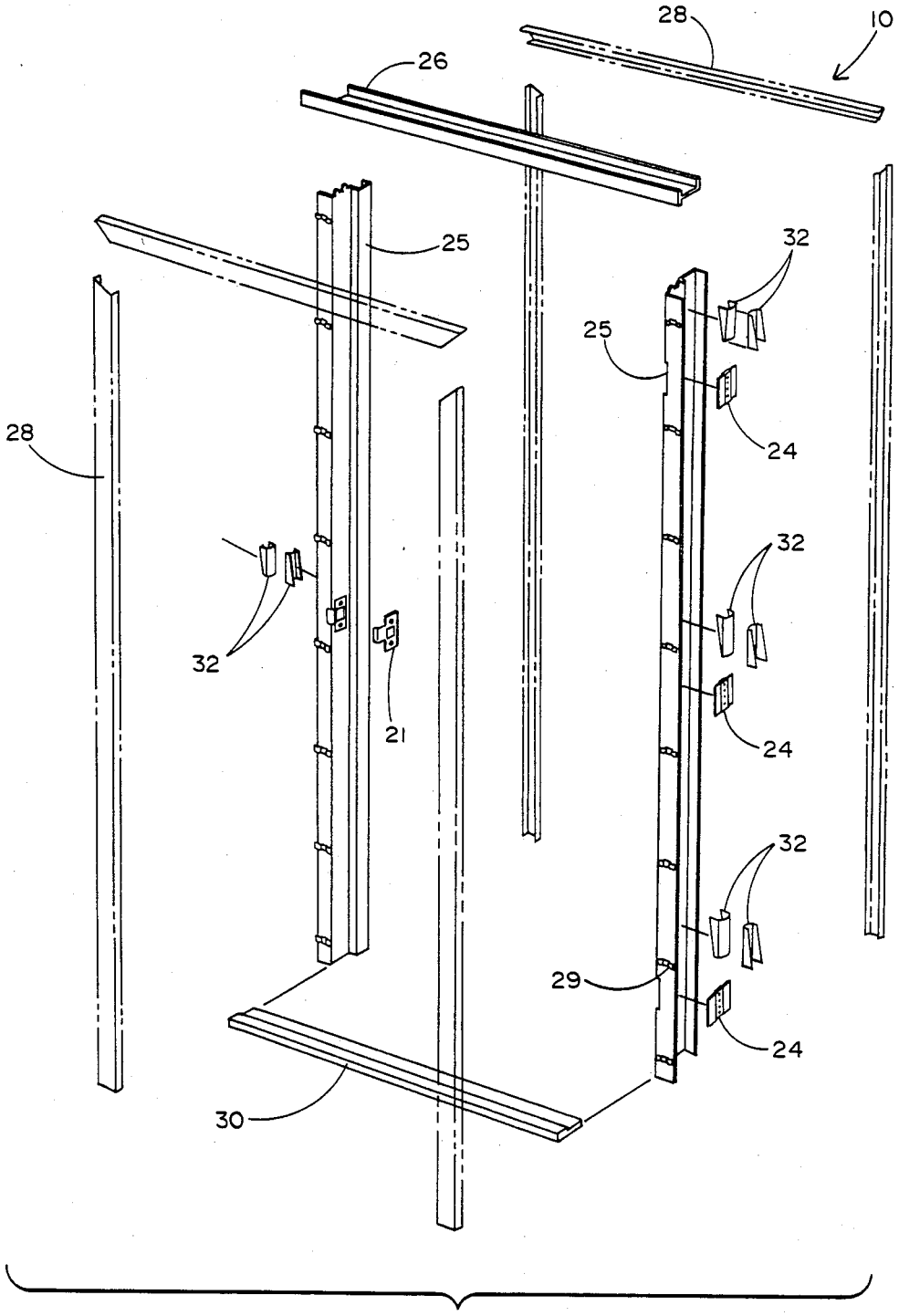
FIG. 2 is an exploded view illustrating the various components of the present invention.
Figure 3:
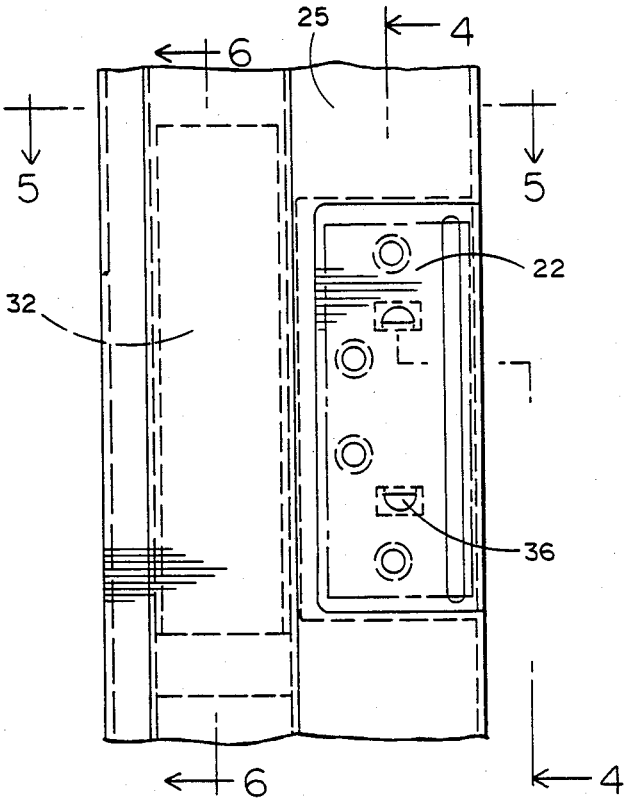
FIG. 3 is an enlarged cut-away view of a portion of a vertical member of the present invention.
Figure 4:
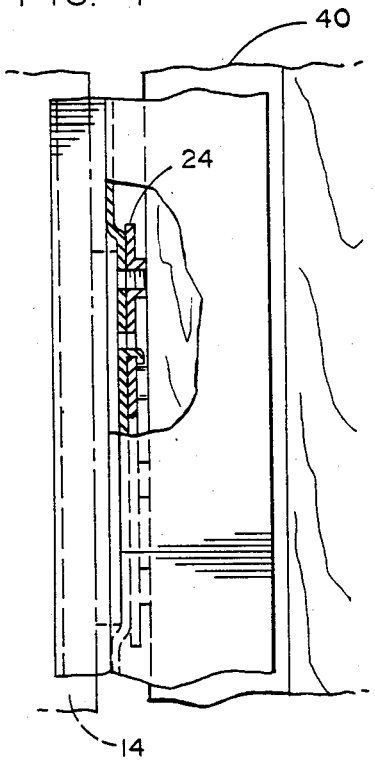
FIG. 4 is an enlarged partially cross-sectioned view of the hinged portion of the present invention taken along lines 4—4 of FIG. 3.
Figure 5:
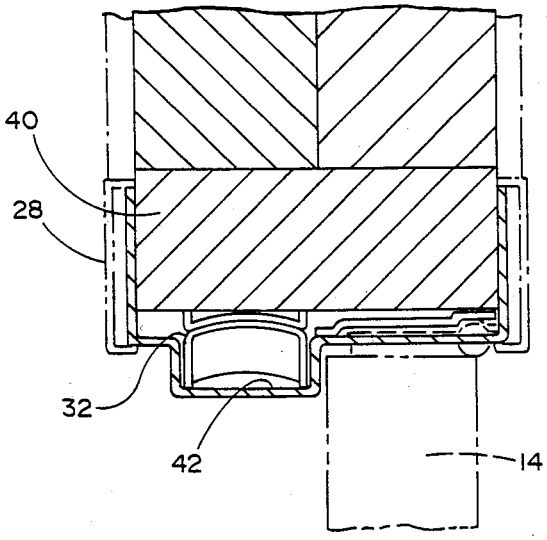
FIG. 5 is a cross-sectional view of a vertical member of the present invention taken along lines 5—5 of FIG. 3.

The key feature of the present invention resides in a plurality of pairs of wedge members 32 which, as seen in FIG. 2, in the preferred embodiment of the invention one such pair is provided on the striker plate side of a first vertical member 25 and three such pairs of wedges are provided on the hinged side of a second vertical member 25. As seen best in FIGS. 5 and 8, each of the two vertical members 25 is designed to be secured to an underlying wood stud member 40 and more specifically to a stud interface surface 15 thereof. Each vertical member 25 is provided with a wedge space 42 preferably along the entire length thereof, this space being adapted to receive one or more sets of wedge members 32.

The specific geometrical configuration of the wedge members 32 is shown best in FIGS. 7 and *7a*. More specifically, as see in these figures, each wedge is substantially identical insofar as having a generally triangular to trapezoidal side member and being substantially longer than it is deep. However the wedge members differ in that one wedge member, namely, wedge member 32*a* provides a concave interface surface 33*a* while the second wedge member 32*b* provides a convex interface surface 33*b*. These two surfaces are designed to interface or engage in a contiguous manner as shown for example in FIGS. 5 and 11 where they provide a means for supporting the vertical frame member 25 against the interface surface 15 of the adjacent stud 40. The wedge members can be translated relative to one another to effectively alter the overall width of the door frame assembly. Unfortunately, as previously indicated, the stud surface 15 is not always a smooth straight surface perpendicular to the door 14. Accordingly, the wedge members 42 are also designed to provide a means for securing the respective vertical members 25 to the interface stud surface 15 in a manner which compensates for the warped or otherwise irregular characteristic of surface 15. The wedge members still provide suitable seats for the corresponding vertical frame member 25 which enables the frame member to be assembled for receiving the door 14 with all regular services being parallel or perpendicular to the plane of the frame as the case may be without any skewing resulting from the irregular surface of the stud 40. Assembly 12 can also be fully fabricated and assembled off site and brought to the site as a fully assembled rectangular structure.

The manner in which the wedge members 32 can be reoriented relative to one another to compensate for such irregular surface stud members is shown in FIG. 7*a* wherein wedge member 32*a* has been rotated clockwise relative to wedge member 32*b* to compensate for a substantial distortion of the stud interface surface 15 adjacent thereto. The manner in which the wedge members may be adjusted in linear translation relative one to the other for varying overall frame width, is evident from FIG. 6. Clearly, the closer the wedge members are to being aligned longitudinally, the greater is the distance between frame member 25 and stud 40.

The vertical frame members 25 are provided with a suitable wedge space 42 to receive the wedge members. This wedge space should be sufficiently large to permit some degree of rotation of one wedge member with respect to the other in order to permit the compensation for stud surface warp or other irregular configurations as described above. One vertical frame member 25 is assembled to the door frame stud 40 and has a hinge plate including a plurality of tabs 36 secured thereto in a standard manner as shown in FIGS. 3–8, while the other vertical member is secured utilizing a pair of tapped holes 44 and a bolt cavity 46 in the adjoining stud 40 in a conventional manner as shown in FIGS. 9–12.

It will be understood that what has been disclosed herein comprises an improved framing assembly preferably made of metal but adapted to be installed in a wood or steel frame structure. The framing system may be configured as a door assembly, window assembly or other such opening and is characterized by novel vertical frame members adapted to receive at least one set of unique wedge members. Each such set comprises a pair of such members, each such member having a common interface surface in contact with a contiguous wedge member, the interface surfaces being complementary in the shape of an arcuate curve thereby permitting translation as well as rotation of one wedge member relative to the other in order to compensate for distance between stud members and for stud members having interface surfaces which may be warped or otherwise irregularly shaped.

Those having skill in the art to which the present invention pertains will, as a result of the applicant's teaching herein, now perceive various modifications and additions which may be made to the present invention. Thus by way of example, wedge members of other geometrical configurations besides those shown herein may be substituted therefor while still achieving the adjustability feature of the present invention which permits attachment of metal vertical members to irregularly surfaced wood or steel stud members. Accordingly, it will be understood that all such modifications and additions are deemed to be within the scope of the invention which is to be limited only by the claims appended hereto.

I claim:

1. An improved framing assembly such as for use as a frame, for doors and windows; the assembly having a pair of prefabricated metal vertical members adapted for attachment to a corresponding pair of wood or steel studs defining a border for the frame; the improvement comprising:

at least one set of wedge members, each such set having a pair of oppositely facing compressively engaged wedges having contiguously abutting surfaces, the abutting surface of each such wedge having an elongate arcuate shape, one such wedge abutting surface being an inversion of the other wedge abutting surface, whereby one such wedge may be rotated relative to the other such wedge while maintaining such compressively engaged contiguously abutting relation for enabling compressive stable affixation of said vertical members to said studs despite a warped wood or steel stud surface; and an elongated channel along each such vertical member for receiving said set of wedge members between said vertical members and said studs.

2. The improvement recited in claim 1 wherein one said wedge abutting surface is concave and the other said wedge abutting surface is convex.

* * * * *